US009657246B2

(12) United States Patent
Barclay et al.

(10) Patent No.: US 9,657,246 B2
(45) Date of Patent: May 23, 2017

(54) PROCESS FOR NATURAL GAS LIQUEFACTION

(75) Inventors: Michael Barclay, Berkshire (GB); Paul Campbell, Wiltshire (GB); Xiaoxia Sheng, Singapore (SG); Wen Sin Chong, Singapore (SG)

(73) Assignee: Keppel Offshore & Marine Technology Centre Pte Ltd (SG)

( * ) Notice: Subject to any disclaimer, the term of this patent is extended or adjusted under 35 U.S.C. 154(b) by 550 days.

(21) Appl. No.: 13/262,207

(22) PCT Filed: Mar. 29, 2010

(86) PCT No.: PCT/GB2010/050532
§ 371 (c)(1),
(2), (4) Date: Nov. 8, 2011

(87) PCT Pub. No.: WO2010/112909
PCT Pub. Date: Oct. 7, 2010

(65) Prior Publication Data

US 2012/0047943 A1 Mar. 1, 2012

(30) Foreign Application Priority Data

Mar. 31, 2009 (GB) ..... 09055773

(51) Int. Cl.
*F25J 1/00* (2006.01)
*C10L 3/10* (2006.01)
(Continued)

(52) U.S. Cl.
CPC ..... *C10L 3/102* (2013.01); *C10L 3/10* (2013.01); *F25J 1/004* (2013.01); *F25J 1/005* (2013.01);
(Continued)

(58) Field of Classification Search
CPC ..... F25J 1/0022; F25J 1/0042; F25J 1/0072; F25J 1/004; F25J 1/021; F25J 1/003; F25J 1/0097; F25J 1/0238; F25J 1/0278; F25J 1/0284; F25J 1/023; F25J 1/0248; F25J 1/0283; F25J 1/0288; F25J 1/0294
(Continued)

(56) References Cited

U.S. PATENT DOCUMENTS 3,315,477 A * 4/1967 Carr ..... 62/612
3,413,817 A * 12/1968 Kniel ..... 62/613
(Continued)

FOREIGN PATENT DOCUMENTS

EP 0360229 A2 3/1990
EP 2414757 A2 2/2012
(Continued)

OTHER PUBLICATIONS

Search Report from European Patent Office for Application PCT/GB2010/050532 dated Jul. 4, 2009.
(Continued)

*Primary Examiner* — Frantz Jules
*Assistant Examiner* — Brian King
(74) *Attorney, Agent, or Firm* — Honigman Miller Schwartz and Cohn LLP

(57) ABSTRACT

A natural gas liquefaction process suited for offshore liquefaction of natural gas produced in association with oil production is described.

17 Claims, 4 Drawing Sheets

(51) Int. Cl.
*F25J 1/02* (2006.01)
*F25J 3/02* (2006.01)

(52) U.S. Cl.
CPC ..... *F25J 1/0022* (2013.01); *F25J 1/0042* (2013.01); *F25J 1/0072* (2013.01); *F25J 1/0097* (2013.01); *F25J 1/021* (2013.01); *F25J 1/023* (2013.01); *F25J 1/0205* (2013.01); *F25J 1/0238* (2013.01); *F25J 1/0248* (2013.01); *F25J 1/0278* (2013.01); *F25J 1/0283* (2013.01); *F25J 1/0284* (2013.01); *F25J 1/0288* (2013.01); *F25J 1/0289* (2013.01); *F25J 1/0294* (2013.01); *F25J 3/0209* (2013.01); *F25J 3/0233* (2013.01); *F25J 3/0238* (2013.01); *F25J 3/0242* (2013.01); *F25J 3/0247* (2013.01); *F25J 2200/74* (2013.01); *F25J 2215/62* (2013.01); *F25J 2220/60* (2013.01); *F25J 2220/62* (2013.01); *F25J 2220/64* (2013.01); *F25J 2230/22* (2013.01); *F25J 2230/60* (2013.01); *F25J 2240/40* (2013.01); *F25J 2270/90* (2013.01); *F25J 2290/72* (2013.01)

(58) Field of Classification Search
USPC ..... 62/617, 618, 619, 620, 630; 7/617
See application file for complete search history.

(56) References Cited

U.S. PATENT DOCUMENTS

| | | | | |
|---|---|---|---|---|
| 3,677,019 | A | 7/1972 | Olszewski | |
| 3,742,721 | A * | 7/1973 | Bourguet et al. | 62/611 |
| 4,339,253 | A * | 7/1982 | Caetani | F25J 1/0022 62/114 |
| 4,707,996 | A * | 11/1987 | Vobach | 62/114 |
| 5,025,860 | A | 6/1991 | Mandrin | |
| 5,551,256 | A | 9/1996 | Schmidt | |
| 5,768,912 | A * | 6/1998 | Dubar | 62/613 |
| 5,878,814 | A | 3/1999 | Breivik et al. | |
| 6,003,603 | A | 12/1999 | Breivik et al. | |
| 6,250,244 | B1 | 6/2001 | Dubar et al. | |
| 6,321,560 | B1 * | 11/2001 | Krys | 62/402 |
| 6,539,747 | B2 * | 4/2003 | Minta et al. | 62/620 |
| 6,658,891 | B2 | 12/2003 | Reijnen et al. | |
| 6,758,060 | B2 * | 7/2004 | O'Brien | 62/631 |
| 6,889,522 | B2 | 5/2005 | Prible et al. | |
| 7,165,423 | B2 * | 1/2007 | Winningham | 62/620 |
| 7,386,966 | B2 | 6/2008 | Griggs et al. | |
| 7,386,996 | B2 | 6/2008 | Fredheim et al. | |
| 2003/0089125 | A1 * | 5/2003 | Fredheim | F25J 1/0022 62/612 |
| 2007/0012072 | A1 * | 1/2007 | Qualls et al. | 62/613 |
| 2009/0255294 | A1 * | 10/2009 | Teo | 62/613 |
| 2010/0107684 | A1 * | 5/2010 | Minta | F25J 1/0022 62/613 |

FOREIGN PATENT DOCUMENTS

| | | | |
|---|---|---|---|
| GB | 1181049 | A | 2/1970 |
| GB | 2462125 | A | 1/2010 |
| WO | WO-0140725 | A1 | 6/2001 |
| WO | WO-2006/049885 | A2 | 5/2006 |
| WO | WO-2007/021351 | A1 | 2/2007 |
| WO | WO 2008009930 | A2 * | 1/2008 |
| WO | WO-2008134136 | A1 | 11/2008 |

OTHER PUBLICATIONS

S Walther et al: "Putting the pieces in pace" LNG Industry, 2008, XP55031208.

Trocquet B et al: "The latest in Floating LNG Technologies", Internet Citation Mar. 10, 2008, XP007904983.

Walther S et al: " Liquefaction solutions for challenge of offshore FPSO Developments" LNG Journal, Nelton Publications, Gravesend, GB Feb. 1, 2008.

Search Report from U.K. Patent Office for Application GB0905577.3 dated Jul. 16, 2009.

F. Faber, A.E.J. Bliault, L.R. Resweber, and P.S. Jones, "Floating LNG Solutions from the drawing board to reality". OTAC14100, 2002.

John A. Sheffield, "Offshore LNG production—How to make it happen", Business Briefing: LNG Review 2005.

Michael Barclay and Noel Denton, "Selecting offshore LNG processes", LNG Journal, Oct. 2005, p. 34-36.

David Woods, Saeid Mokhatab, and Michael J. Economides, "Offshore natural gas liquefaction process selection and development issues". SPE 109522, 2007.

Examination Report from U.K. Patent Office for Application GB0905577.3 dated Feb. 1, 2013.

* cited by examiner

PROCESS FOR NATURAL GAS LIQUEFACTION

FIELD OF THE INVENTION

The present invention relates to a natural gas liquefaction process, and particularly relates to an offshore apparatus for liquefying natural gas associated with oil production.

BACKGROUND OF THE INVENTION

This invention relates to a method for offshore production of liquefied natural gas (LNG), wherein the gas is supplied from an underground reservoir as either associated or non-associated gas. In the case of associated gas, which is produced in association with oil production, there is no way to transport it to market in the absence of a pipeline. This gas has often historically been flared. More recent aspirations to decrease the environmental consequences of producing oil have increasingly led to the gas being re-injected into underground reservoirs. This is costly and not always practical. Liquefaction of this gas offers a way to transport this gas to market by reducing the gas volume in the liquid phase at low temperatures.

Increasingly, liquefaction of natural gas in non-associated stranded gas fields has been considered to allow these stranded resources to be exploited. Offshore liquefaction of natural gas has not yet seen widespread implementation because of a few fundamental limitations. LNG is required to be produced and stored at low temperatures. This introduces a number of challenges.

One of the first challenges to the liquefaction of associated gas is developing a liquefaction process and transportation system that meets the requirements of the gas producers. An associated gas producer's primary interest and revenue streams are often associated with crude oil production. Naturally, this means that their requirements are considerably different than those of either onshore LNG producers or offshore large-scale LNG producers from non-associated gas fields. Prime consideration therefore has to be given to natural gas liquefaction processes which complement the oil production and processing operations in an offshore environment.

However, because the prior art has tended to focus on adapting the existing on-shore concepts to offshore liquefaction, there remain several limitations of the prior art when applied to associated gas processing. The limitations of the prior art when applied to associated gas processing are:

- Process availability has been based on onshore LNG schemes that tend to focus on single trains of large compressors that must all be running to produce LNG;
- Prioritising process efficiency at the expense of operability by developing dual expander and mixed refrigerant processes adapted to attempt to preserve efficiency expected at large scale onshore LNG plants, which increases the process complexity;
- Inherent safety has typically been compromised by hydrocarbon inventories within mixed refrigerant processes but also by the amount of cryogenic processing equipment, and the operator's unfamiliarity with extensive cryogenic processing;
- Prior processes have failed to recognise and address the implication that personnel working in crude oil production and processing may not be familiar with cryogenic processes, equipment, or storage.

Process availability is critical for associated gas producers because an unavailable plant means that either crude oil production is decreased or the gas is flared whilst the plant is down. Adopting on-shore large-scale LNG processes has resulted in minimum redundancy and acceptance of a resultant loss in availability when one of the large compressor sets is down. The present invention seeks to address this limitation of the prior art.

Operability is another limitation of many of the processes developed for offshore liquefaction. As is appreciated by those skilled in the art, operability is generally improved when a process has solid anchor points for robust control, a low equipment count, minimal compositional complexity (including refrigerants) or minimal process recycles.

Many offshore processes are geared towards large scale constant rate gas production profiles. The scale of this production is usually governed by the size of the LNG carrier and LNG storage volumes. The present invention seeks to take account of declining gas production rates typically associated with oil production operations.

Inherent safety is a big driver offshore. Some highly efficient onshore processes derived from mixed refrigerant and dual mixed refrigerant processes offer very good thermodynamic performance but at the cost of decreased inherent safety, increased process complexity, and decreased operability.

The present invention seeks to deliver a robust, simple, and highly available process with a thermodynamic performance and inherent safety levels not available in existing processes.

In recent years, much research has been started to look for a natural gas liquefaction process that is especially suitable for offshore application. Several liquefaction cycles have been proposed for the liquefaction on a Floating Production, Storage and Offloading vessel (FPSO). Reijnen and Runbalk (U.S. Pat. No. 6,658,891B2) from Shell Research Ltd developed a LNG liquefaction process for offshore applications by using a two-phase single mixed refrigerant with a pre-cooling evaporating refrigerant. However, the complexity of the mixed refrigerant greatly influences the offshore operation and safety issues.

A nitrogen refrigeration cycle may be more appropriate for small-scale offshore operations. Although a nitrogen cycle has the disadvantage of lower thermal efficiency, fuel consumption is a less significant cost item in the overall scheme of the whole facility, and so a nitrogen cycle may be advantageous in terms of safety and energy footprint.

Prible et al (U.S. Pat. No. 6,889,522 B2) proposed an LNG production process from offshore stranded gas reserves using dual independent expander refrigeration cycles. Nitrogen and methane are used as refrigerants for the two separate cycles. Fredheim et al. (U.S. Pat. No. 7,386,996 B2) also developed an offshore LNG plant using a carbon dioxide based pre-cooling circuit cascade associating with a nitrogen-rich main cooling circuit. The process efficiency is improved by mixing with the nitrogen small amounts of hydrocarbons, though the inherent safety is compromised. The cascade arrangement of the process limits the LNG process in large scale applications.

Dubar et al. from BHP Petroleum PTY Ltd (U.S. Pat. No. 6,250,244 B1) proposed an offshore liquefaction apparatus using a dual expander cycle for the gas phase refrigerant which is typically nitrogen. The split of nitrogen refrigerant reasonably distributes the cold energy required in the different temperature ranges resulting in better fitting of the cooling curve. The process is suitable for offshore small scale LNG production from stranded gas.

However, all the above offshore LNG production processes focus on relatively large scale (>1 MTPA) processes and the feed gas is mainly stranded gas from the gas field. However, little attention is paid to the rich associated gas which serves as the feed gas of an offshore LNG plant. The increasing use of offshore oil production apparatus (e.g. FPSO) makes the associated gas widely obtainable. Due to the heavy hydrocarbon containing properties of the associated gas, natural gas liquids (NGL) extraction is necessary before the feed gas enters the main liquefaction heat exchanger to avoid the freezing of heavy components at cryogenic temperatures, thus a need for good heat integration exists to keep both the NGL extraction and the LNG process efficient and economical.

SUMMARY OF THE INVENTION

In accordance with the present invention there is provided a process for the offshore liquefaction of a natural gas feed, the process comprising:

(a) contacting the natural gas feed with a biphasic refrigerant at a temperature T1;

(b) contacting the natural gas feed with a first gaseous refrigerant at a temperature T2;

(c) contacting the natural gas feed with a second gaseous refrigerant at a temperature T3; and (d) expanding the refrigerated natural gas feed using an expansion device to form a flash gas stream and a liquefied natural gas stream;

wherein T1, T2 and T3 satisfy the inequality T1≥T2≥T3, and wherein at least a portion of the first gaseous refrigerant following contact with the natural gas feed is expanded in a substantially isentropic process and used to further cool the natural gas feed; and wherein the flash gas stream is recycled for use as the second gaseous refrigerant.

The biphasic refrigerant may be a liquid-gaseous refrigerant.

The refrigerant may be operating in a closed loop vapour compression cycle. The closed loop vapour compression cycle may be referred to as a warm closed loop cycle. The vapour compression cycle may be electric motor driven.

The refrigerant may contact the natural gas feed indirectly. References in this specification to fluids contacting one another indirectly mean that the fluids do not mix, but are separated in a manner which enables heat transfer to take place between them.

The refrigerant may be non-toxic. The refrigerant may be non-ozone depleting. The refrigerant may be non-flammable. For example, the refrigerant may be a commercial refrigerant such as R507 or R134a. The refrigerant may be a mixture of R507 and R134a.

The first gaseous refrigerant may comprise substantially nitrogen.

The first gaseous refrigerant may contact the natural gas feed indirectly. The first gaseous refrigerant may be operating in a closed loop compressor loaded expander cycle, which may be referred to as an intermediate temperature closed loop. The compressor loaded expander cycle may account for at least 65% of the total process load and may be driven by gas turbine.

The natural gas feed may be produced in association with offshore crude oil production.

The natural gas feed may be pre-treated to recover any less volatile hydrocarbons present in the feed prior to the liquefaction process.

The hydrocarbon stream may be returned to crude production facilities for management.

The process may be operated to recover a separate LPG product stream in addition to an LNG stream. Alternatively, ethane, propane, and butane may be retained in the rich LNG stream.

The direct expansion of the natural gas feed may result in a two-phase fluid of which at least a portion of the liquid stream is retained as an LNG product and the cold energy from the remaining vapour stream is recovered against the high pressure natural gas feed prior to expansion. The vapour stream may be referred to as a flash gas stream. The flash gas stream may be the second gaseous refrigerant. The second gaseous refrigerant may contact the natural gas feed indirectly. The second gaseous refrigerant may be operating in an open cycle referred to as a low temperature refrigeration cycle.

The direct expansion of the natural gas feed may occur through an expansion device selected from an expansion valve; a liquid turbine with a wholly or substantially liquid outlet followed by an expansion valve; a flashing expander; a turboexpander.

The liquefaction process may take place in a heat exchanger. The heat exchanger may be a cryogenic heat exchanger. The refrigerated natural gas feed may be expanded in more than one stage wherein more than one pressure of flash gas is returned to the heat exchanger, warmed, and fed to a flash gas compressor.

Vapour associated with LNG storage and transfer to storage that is cold and largely continuous may be blended with the flash gas prior to being returned to the MCHE, warmed, and fed to a flash gas compressor.

The natural gas feed may undergo dehydration and mercury removal prior to liquefaction.

After warming, the flash gas may be compressed to at least the feed gas pressure downstream of dehydration and mercury removal unit operations and blended with said feed gas. The flash gas compressor may be an integrally geared compressor or a screw-type compressor. The compressor may be electric motor driven.

The mixture of flash gas and feed gas may be further compressed in at least one stage of compression located downstream of heavy hydrocarbon extraction, acid gas removal and dehydration and located upstream of liquefaction. Compression may be to a pressure of at least the fuel gas system pressure such that the compressed feed gas can be fed to the gas turbines without additional compression.

The fuel gas for the gas turbine may be sourced from the blend of gas at least a portion of which is derived from flash gas.

The regeneration gas for the molecular sieve dehydration system may be sourced from the blend of gas at least a portion of which is derived from flash gas.

The closed-loop vapour compression cycle apparatus may comprise at least one compressor, one condenser, one accumulator, and at least two heat exchangers that provide cooling in association with a heavy hydrocarbon extraction and gas chilling upstream of liquefaction.

The compressor may comprise at least one screw compressor or at least one reciprocating compressor.

Multiple refrigeration compressors may be used with a single refrigeration system such that the outage of a single refrigeration compressor can either be essentially immediately replaced by an idle machine or result in only a incremental decrease in LNG production of not greater than ⅓.

Multiple refrigeration systems or modules may each comprise at least one compressor, at least one condenser and at least one accumulator. These modules may be integrated as a package such that the outage of a single refrigeration system can either be essentially immediately replaced by an idle package or result in only a incremental decrease in LNG production of not greater than ⅓.

At least a portion of the biphasic refrigerant may contact the natural gas feed upstream of the cryogenic heat exchanger.

The biphasic refrigerant may contact the natural gas feed in a low pressure level kettle. The low pressure kettle may be an evaporator. The low pressure kettle may be a scrub column overhead condenser. The biphasic refrigerant in the low pressure kettle may be at a temperature in the range of from about −50° C. to about −20° C. The biphasic refrigerant in the low pressure kettle may be at an absolute pressure in the range of from about 1 bar to about 2 bar.

The biphasic refrigerant may contact the natural gas feed in a high pressure kettle. The high pressure kettle may be a feed gas chiller. The high pressure kettle may be a condenser. The high pressure kettle may be a scrub column overhead condenser. The biphasic refrigerant in the high pressure kettle may be at a temperature in the range of from about 0° C. to about 20° C., for example from about 0° C. to about 15° C. The biphasic refrigerant in the high pressure kettle may be at an absolute pressure in the range of from about 4 bar to about 6 bar.

In accordance with the present invention, the associated gas feed is processed and produces condensate, and rich LNG which contains methane, ethane, propane, and butane, and needs further LPG extraction at the LNG terminal.

The second non-flammable refrigerant closed loop provides the main cooling for liquefaction of natural gas in the main heat exchanger. The open loop plays an important role in the cooling of the liquefied natural gas at the lowest temperature.

The present invention minimises the NGL extraction on the FPSO (floating production and storage offloading vessel) board, which makes the overall process simpler and safer. Only one fractionation column, i.e. scrub column, is needed to extract the condensate and BTX (i.e. benzene, toluene, and xylene). The scrub column can be located before the feed gas treatment (i.e. sweetening, dehydration, and Hg removal) so that dehydration of the raw condensate which is separated from the three phase separator is not necessary before it is fed into the scrub column.

The process according to the present invention is readily operable through the use of fewer columns not adapted for offshore applications and by using operations which are familiar to crude oil operators.

The present invention also offers greater availability of the process by using a pre-cooling refrigeration system, a single $N_2$ compressor or two compressors operating at 50% and a flash gas refrigeration stream. Should the expander of the nitrogen refrigerant cycle fail, limited production of LNG is still possible using the flash gas stream as the sole refrigerant.

The process of the present invention is inherently safe through the use of safe, non-flammable refrigerants and through the minimisation of LPG processing and the minimisation of the total amount of equipment required, in particular the amount of cold equipment required.

In an alternative embodiment in this invention, the associated gas feed is processed and a separate LPG product stream is recovered in addition to an LNG stream. Three fractionation columns are used for the NGL extraction. The first scrub column produces the lean natural gas under specification, the second deethanizer column removes the redundant ethane which is not required in either lean LNG or LPG and condensate, whilst the third debutanizer column delivers the LPG and condensate products, with the first exported to LPG tanks while the latter is spiked to the crude production facilities for management at the oil FPSO from which the associated gas feed originated.

The present invention is ideally suited for associated gas processing, and has the advantage of robustness, simplicity, highly available design with equivalent thermodynamic performance and inherent safety.

BRIEF DESCRIPTION OF THE DRAWINGS

Embodiments of the invention will now be described, by way of example only and without limitation, with reference to the accompanying drawings and examples, in which.

DETAILED DESCRIPTION OF THE INVENTION

Figure 1:
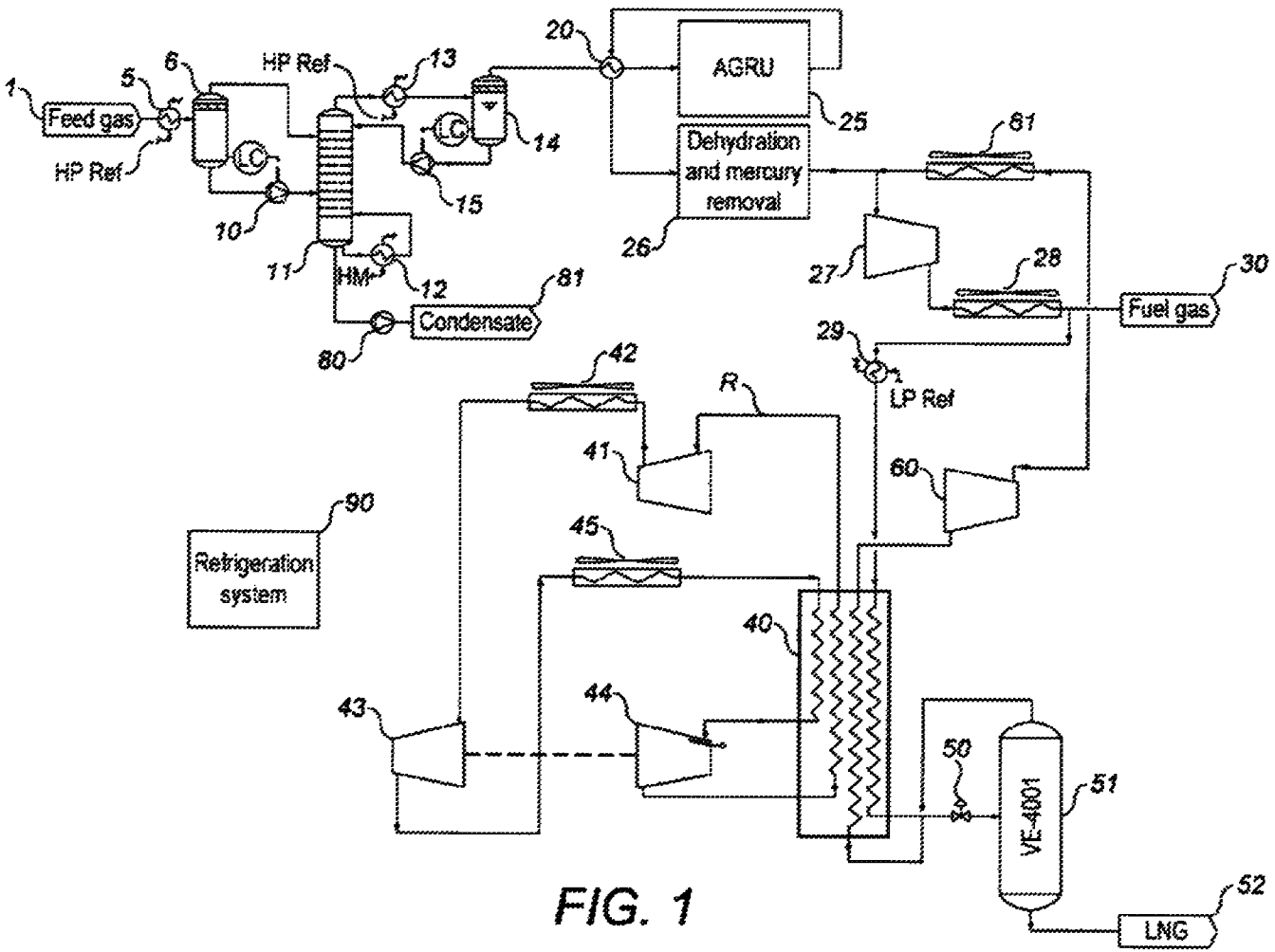
FIG. 1 is a process schematic of a liquefaction process according to the present invention.

Referring to FIG. 1, natural gas 1 flows into the liquefaction process from the offshore production facility. This natural gas is typically associated gas and has undergone various degrees of treatment. The present description will address the case when the feed gas from a crude stabilization unit is at a pressure in the range of about 20 bar to about 30 bar or has been compressed to a pressure in the range of about 20 bar to about 30 bar in oil production gas compressors but has undergone minimal additional treatment such as hydrocarbon dewpointing, dehydration, and acid gas removal. As those skilled in the art will appreciate, the degree of gas treatment at the offshore production facility is highly variable and typically a function of the minimum treatment required to either export via existing pipeline or re-inject the gas. The feed associated gas normally contains more heavy hydrocarbon components than the non-associated gas/stranded gas, and typically comprises methane in the range of from about 60% to about 80%; about 10% of ethane, and propane in the range of from about 5% to about 10%, in mole fraction.

The feed natural gas is firstly cooled and partially condensed in feed gas chiller 5 to a temperature of approximately 5° C. above the hydrate formation temperature. This temperature may be in the range of from about 15° C. to about 20° C. The cooling media for the chiller may be a non-flammable, non-toxic refrigerant operating in a vapour compression cycle, depicted generally at 90. This may be a commercially available refrigerant with a track record in offshore installations such as R134a. Alternative refrigerants such as R507 may be used if lower temperatures are required.

Following chilling, the partially condensed feed gas enters feed gas separator 6 where liquids and vapour are separated. Not shown in FIG. 1, this separator may be a three phase separator if a liquid water phase is present. The vapour is fed to an intermediate tray in distillation or scrub column 11. The liquid hydrocarbon stream is fed to an intermediate tray lower than the vapour from the feed gas separator. The purpose of the scrub column is to remove any heavy hydrocarbon components that could form waxes or freeze as the natural gas is cooled and condensed in the liquefaction equipment.

The scrub column overhead stream is cooled and partially condensed in a scrub column overhead condenser 13 against another high pressure refrigerant from the closed loop refrigeration system 90. Again, because this stream may be subject to free liquids, the hydrate formation temperature for the stream must be avoided. Operation at a temperature in the range of from about 10° C. to about 20° C. is considered typical for associated gas and allows sufficient recovery of heavy hydrocarbons to avoid deposition in downstream equipment and operating within acceptable margins with regard to hydrate formation. The vapour and liquid phases leaving 13 are separated in a scrub column reflux drum 14.

The vapour phase leaving 14 continues to the gas superheater 20 which is a gas-gas heat exchanger that serves to ensure the feed gas entering the amine contactor 25 is at an appropriate temperature for reasonable amine absorption reactivity and to ensure that no free hydrocarbon liquids can drop out in the contactor leading to amine foaming problems. The liquid phase leaving the reflux drum 14 is pumped through the scrub column reflux pump 15 and returned to the top tray as reflux to the scrub column 11.

A bottoms specification, typically based on vapour pressure of the scrub column, is maintained using a scrub column reboiler 12 against a warm heating media stream. The heating media is typically either hot water, steam, or hot oil with a general preference towards hot water systems in the offshore environment. In one preferred embodiment, the stabilised condensate bottom product 81 is returned to the oil production facility to be blended with the crude product via condensate export pump(s) 80. Naturally, this does not preclude alternative arrangements such as on-board storage that may be assessed on a project-by-project basis as needed. The general preference to return condensate to the crude production facility is reflective of the objective to minimise hydrocarbon inventory, operation, and exportation complexity associated with storage and export of an additional product.

The scrub column 11 operates at or near the feed pressure to the plant and several factors must be considered. Firstly, if the feed gas has not been dehydrated in the oil production facilities, free liquids will form in both chillers 5 and 13 creating the hydrate formation risk that has already been identified as well as the potential to flood the trays of the scrub column with free water. Water entering the column will be vaporised near the bottom but largely condensed in the much cooler top of the column, meaning that water will build up in the column unless the design accommodates this feature when required. In these cases the design should include some provision for water management with the scrub column likely including either a boot to allow water draw off from the reflux drum 14 or a water draw off tray(s) in the upper section of scrub column 11 that will allow a condensed water product to be drawn off the trays to avoid water recycle and flooding.

The warmed, superheated gas leaving the gas superheater 20 enters the Acid Gas Removal Unit (AGRU) block 25. The AGRU is typically an amine package that removes $CO_2$ and sulphur species to levels acceptable in the liquefaction process. The lower of two requirements will determine the specification of the amine unit: 1) the level at which acid gas components are soluble in the LNG and 2) the receiving terminal gas send-out specification. Generally, the LNG specification will be the more arduous of the specifications. A typical specification could be higher than the 50-200 ppm(v) $CO_2$ acceptable in most onshore liquefaction terminals depending on both the LNG production pressure (that may be higher than near-atmospheric pressure and the C2-C4 concentration that tends to increase $CO_2$ solubility in liquefied natural gas.

The gas leaving the amine block is water saturated and effectively acid gas component free. It flows through the gas superheater 20 where it is cooled against the gas stream flowing to the AGRU. This reduces the temperature and some water condenses in preparation to the dehydration and mercury removal block 26. Lower temperature feed gas and lower water content both improve the performance of the dehydration system. The feed gas is typically dehydrated to a concentration of less than 1 ppm(v) of water to ensure that water is not deposited as solids in the downstream cold process equipment. The dehydration block typically uses a molecular sieve zeolite to dry the feed gas in a temperature swing adsorption cyclical process. The regeneration gas for the process is taken from the fuel gas stream 30 because this is a "bone dry" and relatively lean stream.

For simplicity, the mercury removal step has been shown as included in the dehydration block. Mercury removal is required to avoid the potential of mercury attack on aluminium plate fin heat exchangers and is typically removed in a fixed absorbent bed containing either sulphur impregnated carbon or increasingly a Zn/Cu sulphide. This base case does not preclude regenerative mercury removal systems that can be combined with the dehydration beds and regenerated at elevated temperature thus decreasing equipment count and required space on the topsides.

The gas leaving the dehydration and mercury removal block 26 is mixed with a partially compressed flash gas from the liquefaction process and compressed in feed gas compressor 27 to a pressure of at least about three bar greater than the fuel gas delivery pressure. A slip stream that is less than the fuel gas demand and typically less than 10% of the feed gas is used as a regeneration case for the molecular sieve dehydration unit. This gas is heated, regenerates the dehydration bed and is then cooled down and free water is removed. This discharge pressure of feed gas compressor 27 is such that the slip stream can regenerate the dehydration bed and then be sent to the gas turbines without further compression. This avoids the need for a dedicated fuel gas or regeneration gas compressor.

The gas leaving compressor 27 is cooled in feed gas compressor aftercooler 28 and then chilled against closed loop vapour compression refrigeration system 90 in a low pressure level kettle (LP Kettle) 29. This kettle cools and may partially condense the feed gas to enhance the thermodynamic efficiency of the process. The optimum temperature is a balance between efficiency and the size of the refrigeration system.

After leaving the LP Kettle 29, the feed gas is cooled and condensed in the main cryogenic heat exchanger (MCHE) 40 against reduced pressure $N_2$ refrigerant operating in the compressor loaded expander cycle and against flash gas streams, prior to flashing across expansion device 50 into the LNG flash drum 51. In one embodiment the expansion device will be a cage guided isenthalpic expansion valve that is proven in this service but thermodynamically inefficient. Alternatives for this expansion device envisaged for the present invention include, but are not limited to, a liquid turbine followed by an expansion valve, a dense phase turboexpander, and a flashing expander as will be understood by those skilled in the art. These alternatives will be described in more detail below.

The fluid leaving expansion device 50 will be reduced in temperature and become biphasic, comprising a vapour portion, referred to as flash gas, which is preferentially enriched in more volatile components such as methane and nitrogen, and a liquid stream referred to as LNG. The vapour molar fraction will typically be at least sufficient to meet the fuel gas demands of the system but not more than about 25% on a molar basis with the optimal value being determined on a project specific basis. The vapour fraction is typically at a temperature in the range of from about −163° C. to about −140° C. and is returned as a cold stream to the MCHE 40 where it cools and condenses the incoming feed gas and is particularly important to provide cooling at the lowest temperatures in the liquefaction system. In some cases, it may be advantageous to mix the vapour fraction from the LNG flash drum with a cold vapour stream (boil off gas or BOG) from LNG storage to recover the cold from this stream and improve the efficiency of the process.

The low pressure, warmed flash gas is recompressed in flash gas compressor 60 and then cooled in flash gas compressor aftercooler 61. This compression will occur in a number of stages depending on the LNG production pressure, feed gas pressure, and other factors. This compressed flash gas is combined with the treated feed gas to complete a cycle prior to compression in feed gas compressor 27.

The majority of the refrigeration required by the process is generated by the closed loop compressor loaded expander cycle, a closed loop, wholly or primarily gaseous turboexpanded-based system. This cycle will be described starting with the warm, lower pressure stream R which is referred to as the LPN Refrigerant (Low Pressure Nitrogen Refrigerant). This stream consists primarily of a $N_2$ refrigerant at a pressure in the range of from about 8 bar to about 15 bar. It should be noted that in some cases the refrigerant may include some natural gas to enhance the performance of the process or may include some other components that typically make-up air.

The LPN refrigerant is compressed in the Nitrogen refrigerant compressor 41 to a pressure in the range of from about 50 bar to about 90 bar in at least one stage of compression. Additional compressor stages may be required. The high pressure $N_2$ refrigerant (HPN refrigerant) is cooled in HPN aftercooler 42 prior to further compression in the expander-compressor 43 that has a typical pressure ratio of 1.5 generating the highest pressure in the closed loop at the outlet of the compressor.

Aftercooler 45 cools the HPN refrigerant to a temperature in the range of from about 3° C. to about 10° C. above the cooling media that is typically either seawater or air. From a thermodynamic perspective, a lower aftercooled discharge temperature results in an increased LNG production for the same refrigeration compressor power.

The HPN refrigerant enters the MCHE and is cooled against the cold LPN refrigerant and flash gas streams to an intermediate temperature. At least a portion of the cooled HPN refrigerant leaves the MCHE and is expanded in the turboexpander 44 that expands the HPN to produce the cold LPN refrigerant. This expansion is completed in a turboexpander to effect a primarily isentropic expansion and a resultant large decrease in temperature. As those skilled in the art will appreciate, an efficient expansion process greatly enhances the efficiency of the process.

Whilst in the illustrated embodiment the turboexpander 44 is loaded with compressor 43 boosting the pressure of the HPN refrigerant, many other embodiments are possible. For instance, the turboexpander shaft power could be converted to electrical power in a generator loaded turboexpander. Alternatively, a compressor loading the expander could recompress the LPN refrigerant prior to compression in the $N_2$ refrigerant compressor. In the case where multiple expanders used for small-scale liquefaction are required, the turboexpander could even rely on an oil brake for loading in a less efficient but simple configuration. It should also be noted that there is a general preference for oil free magnetic bearing machines for this application because they take up less space offshore and eliminate the possibility of oil contamination of cryogenic equipment from the expander system.

The LPN refrigerant at the outlet of the turboexpander 44 is returned as a cold stream to the MCHE 40 and used to provide further cooling. This gas is at a temperature considerably colder that the cooled HPN refrigerant but warmer than the flash gas coming from the LNG flash drum 51 such that it opens the cooling curves in the MCHE at warmer and intermediate temperatures. Typically, the LPN refrigerant is at a temperature in the range of from about −150° C. to about −120° C. This gas is warmed against the warm feed gas and HPN refrigerant streams prior to recompression in the $N_2$ refrigerant compressor 41 to complete the cycle.

The process conditions that optimise performance and equipment sizing for the $N_2$ refrigeration system are a function of project specific variables. What is important is that the closed loop $N_2$ refrigerant system operates at conditions that are within the equipment supplier limits whilst at high enough pressures to avoid excessively large equipment. It is also important that the $N_2$ refrigeration system provides cooling between the flash gas and the feed gas cooling temperature range.

Figure 2:
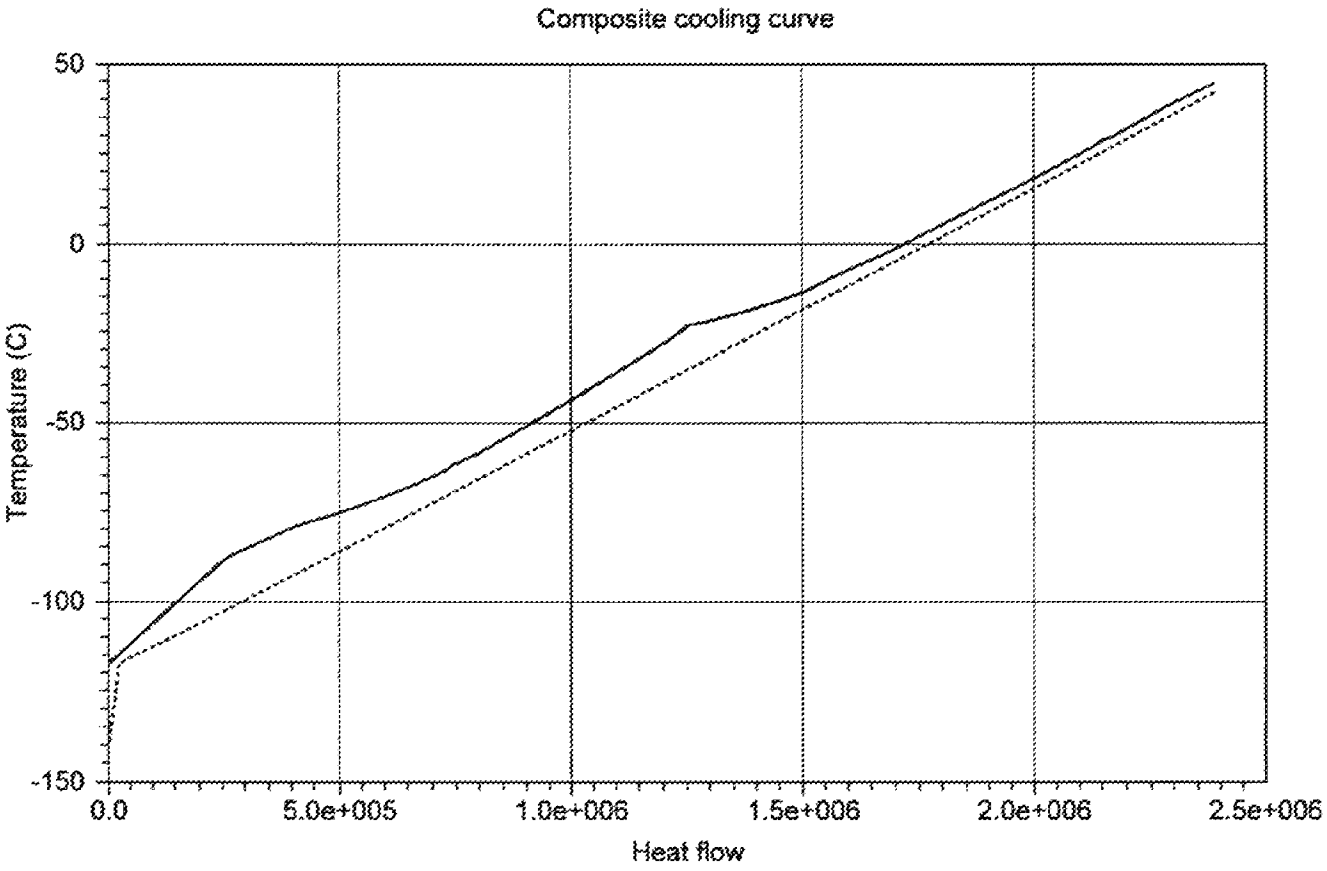
FIG. 2 shows typical cooling curves for the process of the present invention indicating the efficient thermodynamic performance.

FIG. 2 shows the cooling curve of the process described above. The upper line represents the cooling of the natural gas stream. The lower line represents the consolidated heating curve for the refrigerant streams of the present invention. The close fit of the warm stream and cold stream indicates the high liquefaction efficiency of this associated gas liquefaction process.

Figure 3:
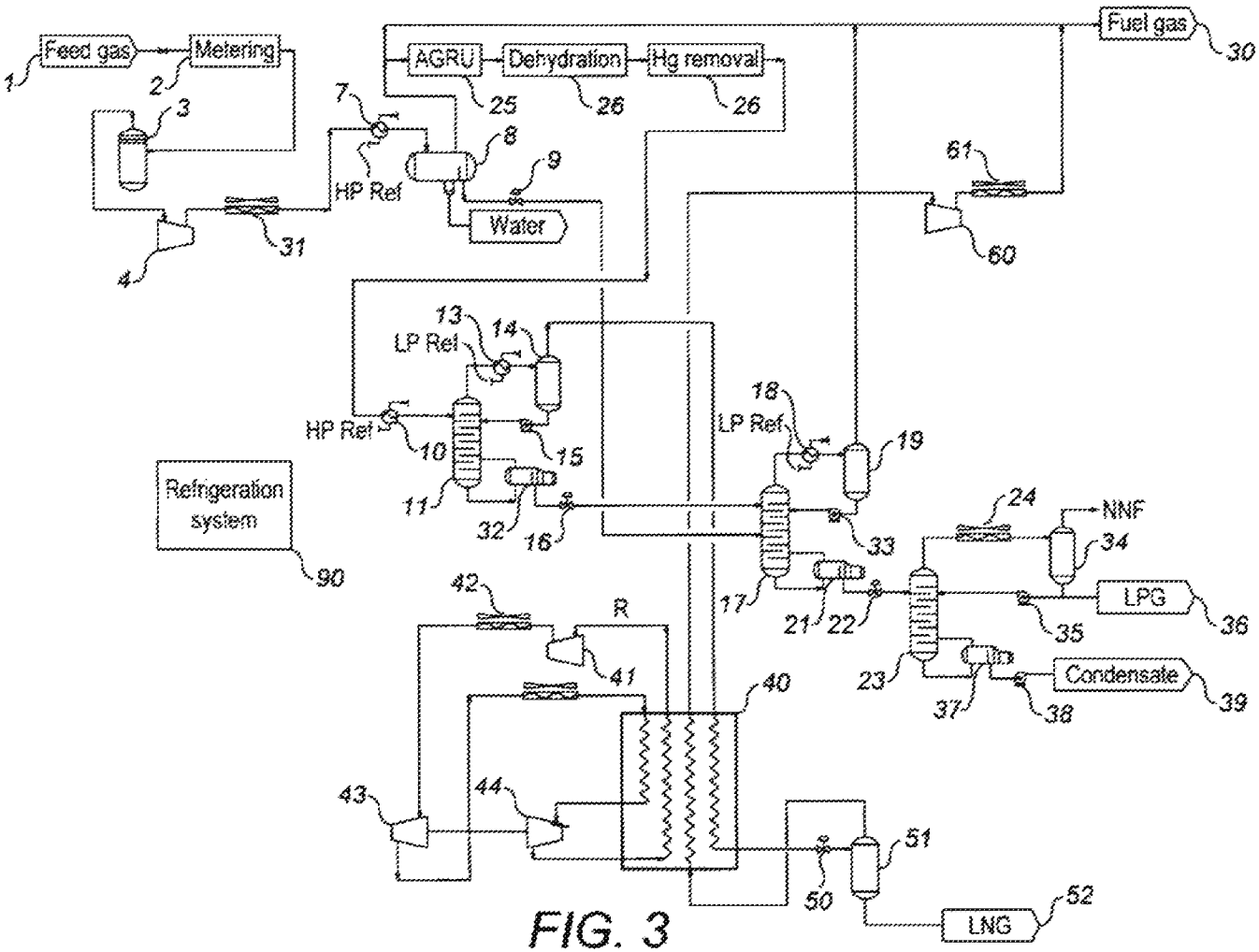
FIG. 3 shows another embodiment of the process suitable for LPG recovery.

FIG. 3 shows an alternative embodiment of the process that has been modified to recover sufficient LPGs to market to existing LNG receiving terminals.

Referring to FIG. 3, the feed gas 1, which is typically associated gas, flows into the liquefaction process from the offshore production facility by first of all passing a metering device 2. The feed gas passes a suction scrub 3 before being fed to the feed gas compressor 4 which compresses it to about 45 bar, and is subsequently cooled down using air cooler 31 or a seawater cooler. The cooled natural gas is further cooled in a chiller and partially condensed in condenser 7 using a high pressure non-flammable refrigerant operating in the closed loop vapour compression cycle of refrigeration system 90.

Following chilling, the partially condensed feed gas enters three-phase feed gas separator 8 where water, liquids and vapour are separated. The vapour passes through a gas sweetening plant (e.g. amine contactor), dehydration bed and mercury removal bed, and then is fed to an intermediate tray in scrub column 11. The purpose of the scrub column is to control the overhead vapour quality that is directly related to the final LNG's higher heating value (HHV) which is typically around 1100 MMBtu/scf, and also remove the heavy hydrocarbon components that could form waxes or freeze when the natural gas is cooled and condensed in the cryogenic liquefaction equipment. The scrub column overhead stream is cooled and partially condensed in a scrub column overhead condenser 13 against a low pressure refrigerant stream from the closed loop refrigeration system 90. Again, to obtain a lean overhead vapour stream that satisfies the LNG specification, operation at a temperature in the range of from about −50° C. to about −40° C. for the scrub overhead condenser 13 is considered typical for associated gas. The fluid with vapour and liquid phases leaving the condenser 13 is separated in a scrub column reflux drum 14.

The liquid phase leaving the reflux drum 14 is pumped by a scrub column reflux pump 15 and returned to the top tray as reflux to the scrub column 11. A reboiler operating at about 120° C. using hot media is used in order to get a better separation of the scrub column. The bottom stream from scrub column 11 is decompressed to a pressure of around 25 bar by decompressor 32 before being further fed to deethanizer column 17. Another liquid hydrocarbon stream from the three phase separator 8 is dehydrated and fed to an intermediate tray of the deethanizer column 17. The purpose of the deethanizer column is to remove the redundant ethane in the feed stream, so that the bottom stream which is fed into the 3rd column can satisfy the LPG and condensate true vapour pressure (TVP) requirement.

A low pressure refrigerant evaporator 18 at typically −22° C. is used to partially condense the deethanizer overhead stream against refrigerant from refrigerant system 90. The liquid is separated in the drum 19 and pumped back to the deethanizer column 17 as a reflux stream by pump 33. The vapour from the drum is sent to the fuel gas system which is used to drive the gas turbines.

The pressure of the deethanizer bottom liquid is further reduced to about 10 bar in pressure reducer 21 and is fed to the 3$^{rd}$ column, i.e. debutanizer 23. The debutanizer column is used to separate the LPG at the overhead and the condensate at the bottom. The condensate has the true vapour pressure of 1 bar at 37° C., and is cooled down in chiller 37 and spiked to the crude storage tank on an oil FPSO using a pump 38. The operating temperature range of debutanizer column 23 is 55° C. (overhead) to 135° C. (bottom). The overhead vapour is fully condensed using air cooler 24 or a water cooler and supplied to a receiver 34.

Part of the liquid collected from the receiver 34 is recycled back to debutanizer column 23 as a reflux stream via pump 35, whilst the rest is exported as a final LPG product 27 and stored either in a pressure vessel at room temperature or in a low temperature vessel at ambient pressure, with the latter needing a chiller using LP refrigerant to cool down to 33° C. and reduce pressure using a JT valve to achieve ambient pressure.

The overhead vapour stream of the scrub column reflux drum 14 is fed into the main cryogenic heat exchanger (MCHE) 40 against cryogenic $N_2$ as refrigerant to supply the main cold energy. The main cryogenic heat exchanger may comprise aluminium brazed plate fins. The inlet natural gas is fully condensed in the MCHE to −145° C. and isenthalpically expanded to around 1-3 bar by passing either a JT valve 50, liquid turbine, dense phase turboexpander, or flashing expander, as described above. The fluid leaving expansion device 50 will be reduced in temperature and become a two-phase stream which is collected in the LNG receiver 51.

The liquid separated from the LNG receiver is stored in LNG tank and exported as LNG product, while the flash gas which mainly contains methane and nitrogen is returned as a side cold stream to the MCHE 40 where it cools and condenses the incoming feed gas and is particularly important to providing cooling at the lowest temperatures in the liquefaction system. The recovery of cold in the flash gas improves the overall process efficiency.

The low pressure, warmed flash gas is recompressed in flash gas compressor 60 and then cooled in a flash gas compression aftercooler 61. This flash gas compression may occur in a number of stages depending on the LNG production pressure, feed gas pressure, and other factors. This compressed flash gas can be served as the molecular sieve regeneration gas, and combined with the deethanizer 17 overhead gas, and the balance untreated feed gas to serve as the fuel gas for the gas turbines.

The nitrogen refrigeration system to provide the main cold for MCHE is as described for the compressor loaded expander cycle in FIG. 1. The process conditions that optimise performance and equipment sizing for the $N_2$ refrigeration system are a function of project specific variables to operate the nitrogen system at conditions that are within the equipment supplier limits (e.g. the limit of design temperature and pressure of the MCHE, the export power limit of turboexpander) whilst at high enough pressures to avoid excessively large equipment. It is also important that the $N_2$ refrigeration system provides the cooling between the cryogenic flash gas and the warm feed gas cooling temperature range.

Figure 4:
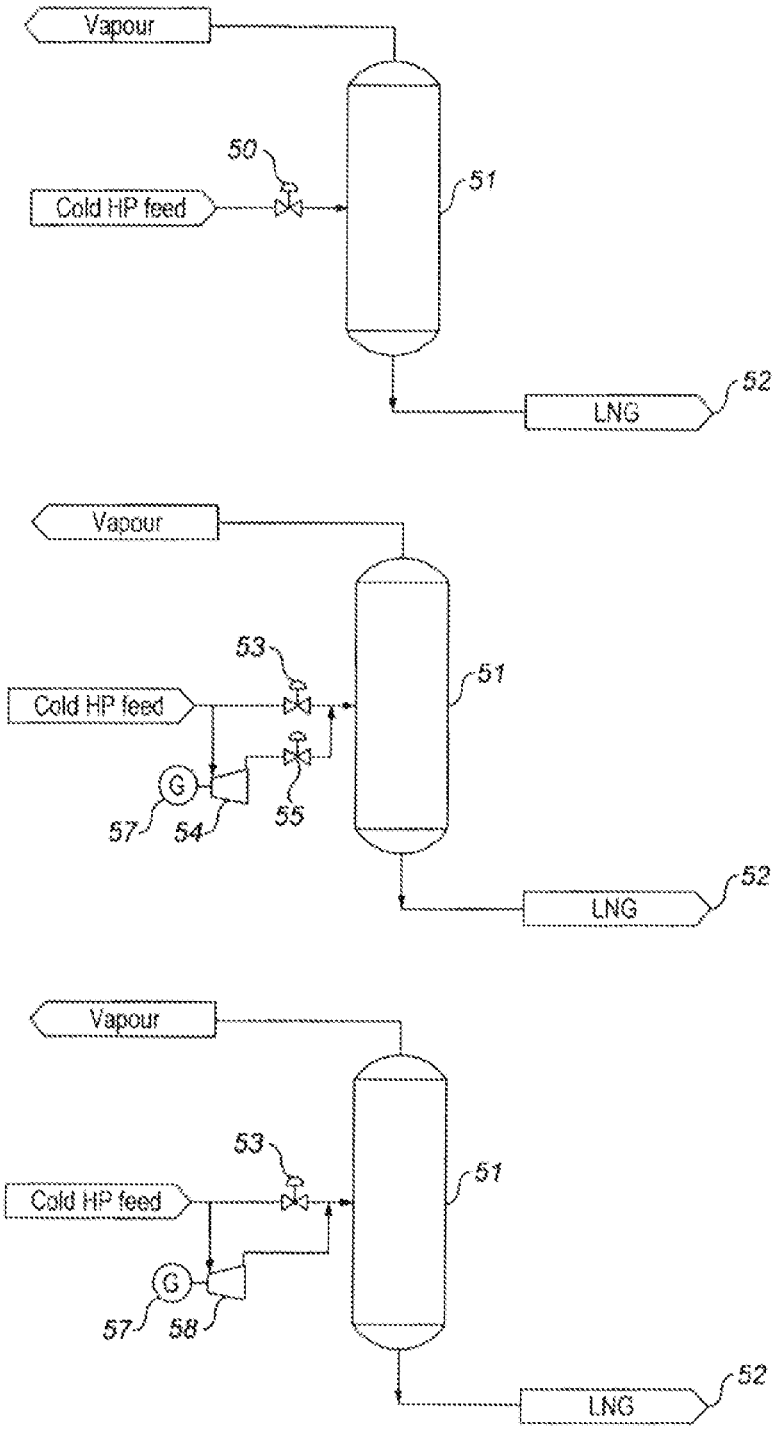
FIG. 4 shows examples of expansion device configurations possible for the end-flash.

FIG. 4 shows a number of expansion device configurations that could be used in the low temperature open cycle end flash in the process. The first sketch shows the simplest embodiment of the process. As previously described, the cooled and condensed natural gas leaving the MCHE 40 is flashed across expansion device 50 into the LNG flash drum 51. As shown in this sketch, an isenthalpic expansion occurs across an expansion valve designed for the severe cryogenic flashing service. In one embodiment the expansion device will be a cage guided isenthalpic expansion valve that is proven in this service but thermodynamically inefficient. The limited efficiency of this isenthalpic expansion manifests itself in a lower liquid fraction at the outlet of the valve and ultimately decreased overall thermodynamic efficiency of the liquefaction process. Alternative arrangements are included within the scope of the present invention and described below.

The second sketch shows a configuration that is commonly used in large-scale LNG installations to improve thermodynamic cycle performance. The cold high pressure fluid from MCHE 40 is reduced in pressure to slightly above the bubble point to ensure a liquid outlet in a liquid turbine 54 in an approximately isentropic expansion. The liquid is then further expanded in isenthalpic expansion valve 55 and flashed into the vapour dome to form the two-phase mixture of flash gas and LNG. Back-up expansion valve 53 is installed in parallel for use during transient operation such as start-up and to allow continued operation when the liquid turbine is down for maintenance.

Note that in this scheme liquid turbine 54 has a liquid or dense liquid-like phase inlet and a liquid outlet. Liquid turbine 54 is loaded by a generator 57 that produces a relatively small amount of power. The value of this generator is that the work extracted from the stream in expansion results in an increased liquid yield and whilst the electrical power could be synchronised with the main electrical power system and be used, it will typically be destroyed in a load cell.

A second alternative to an expansion valve that further enhances the efficiency of the liquefaction process is seen in the third sketch of FIG. 4. In this embodiment, the cold high pressure fluid from MCHE 40 is expanded directly into the vapour dome using a flashing turbine expander 58 in an approximately isentropic expansion. A back-up expansion valve 53 is installed in parallel for use during transient operation such as start-up and to allow continued operation when the liquid turbine is down for maintenance.

Note that in this scheme the flashing expander 58 has a liquid or dense liquid-like phase inlet and a two-phase outlet. The liquid turbine is loaded by a generator 59 that produces more power than generator 57 from the previously described scheme but again, the principal benefit of the isentropic expansion is the resultant increased liquid yield and process efficiency.

The main advantage of the plant as discussed with reference to FIG. 1 and FIG. 3 is the heat integration of LPG production and natural gas liquefaction. By using the closed loop vapour compression cycle refrigeration system 90 to cool the natural gas feed, the overall efficiency of the liquefaction process is improved. Moreover, the improvement of the process efficiency does not compensate on the process safety due to the use of non-flammable, non-toxic refrigerants such as R134A, R507.

EXAMPLES

The present invention has been compared with some other liquefaction cycles. The following examples are given in terms of compressor duty for 80 mmscfd (millions of standard cubic feet per day) of associated gas feed. For all examples, the liquefied natural gas is passed through an expansion device and the resulting flash gas is recycled to provide cooling at the lowest temperatures of the liquefaction process. Table 1 summarises the findings discussed below.

Comparative Example 1

The duty for a single $N_2$ expander cycle driven by gas turbine is 37 MW. This is because when rich gas is served as feed gas, the huge requirement for initial, upper temperature cooling makes the nitrogen refrigerant cycle highly inefficient.

Comparative Example 2

Use of the dual $N_2$ expander cycle reduced the total nitrogen compression duty to 27 MW, which indicates that a smaller gas turbine could be used to drive the nitrogen compressors.

Example 1

In accordance with the present invention, use of the vapour compression cycle refrigerant, in conjunction with a single $N_2$ expander cycle greatly reduces the total duty by more than 13 MW. Furthermore the compressor duty for the nitrogen compressors of this Example is actually smaller than the dual $N_2$ expander cycle of Comparative Example 2. This indicates the small CAPEX need for the plant as the gas turbine is a big cost in the total CAPEX.

Example 2

Use of the vapour compression cycle refrigerant in conjunction with a dual $N_2$ expander cycle results in an even greater reduction in compressor duty. Although the duty is 2 MW less than for Example 1, the same model of gas turbine is still needed, which indicates no cost saving on the gas turbine but greater CAPEX on the second turboexpander.

It is obvious that the present invention is advantageous in terms of the overall process efficiency (with an overall thermal efficiency of 91.13%) and CAPEX.

TABLE 1

Performance comparison of different natural gas liquefaction cycles

| For 80 mmscfd of feed associated gas | Total Compressor duty (MW) | Vapour compression cycle compressor duty driven by electrical motor (MW) | $N_2$ compressor duty driven by gas turbine (MW) | $N_2$ compressor gas turbine selection |
|---|---|---|---|---|
| Comparative Example 1 | 37 | 0 | 37 | LM6000, |
| Comparative Example 2 | 27 | 0 | 27 | PGT25+, RB211-6762 |
| Example 1 | 23.7 | 4.6 | 19.1 | PGT25, RB211-6556, Titan 250 |
| Example 2 | 21.7 | 4.6 | 17.1 | PGT25, RB211-6556, Titan 250 |

The invention claimed is:

1. A process for the offshore liquefaction of a natural gas feed produced in association with offshore crude oil production, the process-comprising:

(a) contacting the natural gas feed with a biphasic non-flammable refrigerant at a temperature T1, wherein the biphasic non-flammable refrigerant operating in a closed loop vapor compression cycle accounts for a first portion of a total electrical load;

(b) contacting the natural gas feed with a first gaseous refrigerant operating in a closed loop compressor loaded single expander cycle at a temperature T2;

(c) expanding the refrigerated natural gas feed using an expansion device to form a flash gas stream and a liquefied natural gas stream; wherein T1 and T2 satisfy the inequality T1≥T2, wherein at least a portion of the first gaseous refrigerant following contact with the natural gas feed is expanded in a isentropic process and used to further cool the natural gas feed; and wherein the first gaseous refrigerant operating in a closed loop compressor loaded expander cycle accounts for a second portion of the total electrical load, wherein the second portion of the total electrical load is at least 65% of the total electrical load; wherein the liquefaction takes place in one cryogenic heat exchanger; and wherein at least a portion of the biphasic refrigerant contacts the natural gas feed upstream of the cryogenic heat exchanger.

2. The process of claim 1, wherein the biphasic non-flammable refrigerant is a liquid-gaseous refrigerant.

3. The process of claim 1, wherein the biphasic non-flammable refrigerant operates in the closed loop vapor compression cycle in a low pressure level kettle.

4. The process of claim 3, wherein the vapor compression cycle is electric motor driven.

5. The process of claim 1, wherein the first gaseous refrigerant comprises substantially nitrogen.

6. The process of claim 1, wherein the closed loop compressor loaded single expander cycle is gas turbine driven.

7. The process of claim 1, wherein the natural gas feed is pre-treated to recover any less volatile hydrocarbons that is present in the natural gas feed prior to the liquefaction process.

8. The process of claim 7, wherein the less volatile hydrocarbons are returned to a crude production facility for management.

9. The process of claim 1, wherein a separate LPG stream is recovered in addition to the liquefied natural gas stream.

10. The process of claim 1, wherein ethane, propane and butane are retained in the liquefied natural gas stream.

11. The process of claim 1, wherein the expansion device is selected from the group consisting of:

an expansion valve, a liquid turbine with a liquid outlet followed by an expansion valve, a flashing expander, and a turboexpander.

12. The process of claim 1, wherein more than one pressure of the flash gas stream is:

(1) returned to the cryogenic heat exchanger, (2) warmed, and (3) fed to a flash gas compressor.

13. The process of claim 1, wherein the natural gas feed undergoes dehydration and mercury removal prior to liquefaction.

14. The process of claim 13 further comprising:

compressing the flash gas stream to at least the pressure of the natural gas feed after dehydration and mercury removal; and mixing the flash gas stream with the natural gas feed.

15. The process of claim 14, wherein the step of mixing the flash gas stream with the natural gas feed further includes:

compressing mixed flash gas stream and natural gas feed in at least one stage of compression prior to forming a liquefied natural gas stream.

16. The process of claim 1, wherein the flash gas stream is recycled for use as a second gaseous refrigerant in the liquefaction process, contacting the natural gas feed at a temperature T3, wherein T2 and T3 satisfy the inequality T2≥T3.

17. The process of claim 1, wherein at least a portion of the biphasic refrigerant contacts the natural gas feed upstream of, and only upstream of, the cryogenic heat exchanger.

* * * * *